US006820645B2

(12) United States Patent
Behl et al.

(10) Patent No.: US 6,820,645 B2
(45) Date of Patent: Nov. 23, 2004

(54) UNLOCKABLE NON-RETURN VALVE FOR VERY HIGH SYSTEM PRESSURES

(75) Inventors: Helmut Behl, Triefenstein (DE); Karl J. H. Cords, Partenstein (DE); Dragoljub Djenadija, Marktheidenfeld (DE); Helmut Etzel, Wiesthal-Krommenthal (DE); Frank Hofmann, Lohr (DE); Michael Reinert, Lohr (DE); Bruno Schneider, Fellen (DE)

(73) Assignee: Bosch Rexroth AG, Lohr/Main (DE)

( * ) Notice: Subject to any disclaimer, the term of this patent is extended or adjusted under 35 U.S.C. 154(b) by 0 days.

(21) Appl. No.: 10/362,536

(22) PCT Filed: Apr. 28, 2001

(86) PCT No.: PCT/EP01/04806

§ 371 (c)(1),
(2), (4) Date: Jul. 16, 2003

(87) PCT Pub. No.: WO02/18799

PCT Pub. Date: Mar. 7, 2002

(65) Prior Publication Data

US 2004/0094207 A1 May 20, 2004

(30) Foreign Application Priority Data

Aug. 31, 2000 (DE) ..... 100 42 716

(51) Int. Cl.[7] ..... F15B 13/01

(52) U.S. Cl. ..... 137/522; 251/63.4

(58) Field of Search ..... 137/522; 251/63.4, 251/63.5

(56) References Cited

U.S. PATENT DOCUMENTS

| | | | | |
|---|---|---|---|---|
| 3,631,887 A | * | 1/1972 | Schlechtriem et al. | 137/522 |
| 3,631,888 A | * | 1/1972 | Anton et al. | 137/522 |
| 4,562,862 A | * | 1/1986 | Mucheyer et al. | 137/522 |
| 4,624,445 A | * | 11/1986 | Putnam | 251/63.4 |

FOREIGN PATENT DOCUMENTS

| | | |
|---|---|---|
| DE | 3904978 | 8/1990 |
| DE | 19714505 | 10/1998 |
| DE | 19856018 | 6/2000 |
| EP | 0687843 | 12/1995 |

* cited by examiner

*Primary Examiner*—Ramesh Krishnamurthy
(74) *Attorney, Agent, or Firm*—Martin A. Farber

(57) ABSTRACT

An unlockable non-return valve reduces the tendency of the poppet piston to jam by providing a first insert that has a guide diameter for the poppet piston over just a short section of its end side facing the piston collar, and wherein a supporting ring is arranged axially between the high-pressure seal and the first insert in a receiving element, the diameter of which is substantially smaller than the outside diameters of the inserts, the supporting ring likewise being produced from a metallic material having good sliding properties and being produced with a narrow clearance from the end section of the poppet piston and with a large radial clearance from the receiving element.

8 Claims, 2 Drawing Sheets

UNLOCKABLE NON-RETURN VALVE FOR VERY HIGH SYSTEM PRESSURES

Figure 1:
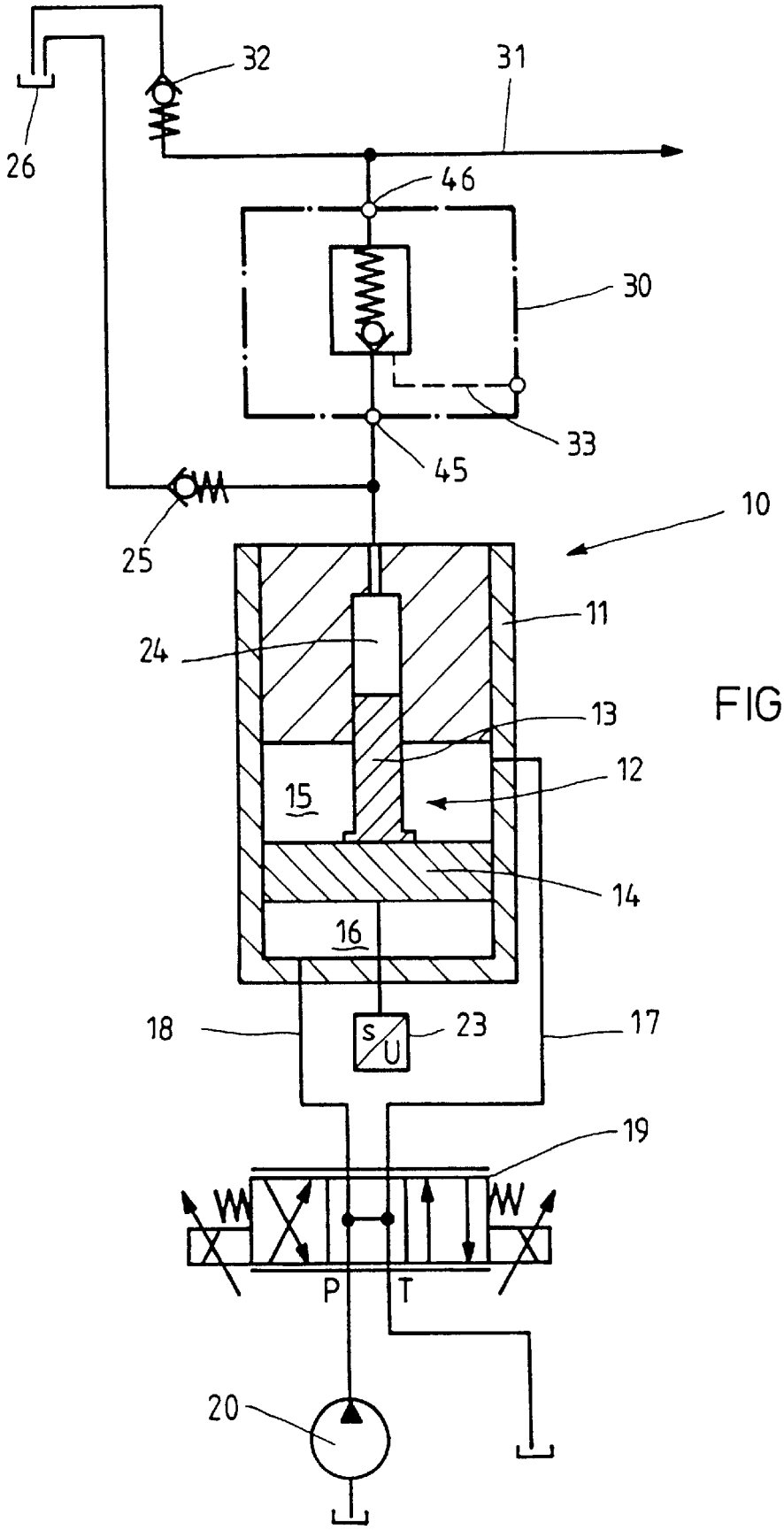

The invention is based on an unlockable non-return valve which is intended to be usable for very high system pressures and which has the features from the preamble of claim 1.

Non-return valves readily permit pressure medium to flow from a first orifice to a second orifice, with the closing element being raised from a seat counter to the force exerted by the pressure prevailing in the second orifice and counter to the force of the closing spring by means of a force produced by the pressure in the first orifice. Since the closing element is conventionally acted upon by the pressures on surfaces of identical size, a pressure arises in the first orifice which is higher than the pressure in the second orifice by a pressure difference which is equivalent to the force of the closing spring. The closing spring is only weak so as to keep the losses via the valve small, unless the intention is to deliberately build up the pressure medium in the first orifice. The flow through a non-return valve in the direction from the second orifice to the first orifice is possible only by additional measures through which an unlockable non-return valve is created. A poppet part is then provided which can act on the closing element in the opening direction and can raise it from the seat counter to the force of the closing spring and counter to the pressure difference between the first and second orifice.

DE 197 14 505 A1 has disclosed an unlockable non-return valve which has all of the features from the preamble of claim 1. The internal high-pressure forming of tubular semi-finished products is mentioned in the above-mentioned document as an example of use of a non-return valve of this type. The non-return valve which is shown has a valve housing having a continuous receiving bore which is stepped and is composed essentially of three sections. The diameter of the receiving bore is larger in the two outer sections than in a central section into which the two outer sections merge in steps lying in radial planes. High-strength inserts which are exposed to the system pressure and inserts serving to guide a poppet piston are placed into the two outer sections. The central section of the receiving bore is divided by a piston collar of the poppet piston into two annular spaces of which the one can be acted upon by control pressure via a pilot valve in order to control the non-return valve or can be relieved from pressure to a tank, and the other is permanently connected to a pressure-medium reservoir and contains a restoring spring for the poppet piston. It has been found that, in the known non-return valve, the poppet piston is not always smooth-running to the desired extent.

DE 198 56 018 A1 has also disclosed an unlockable non-return valve which has, all of the features from the preamble of claim 1 and which is likewise used, in particular, in plants for the internal high-pressure forming of tubular semi-finished products. In the non-return valve shown in DE 198 56 018 A1, the tendency of the poppet piston to jam has been reduced by the fact that the receiving bore has essentially the same diameter in the region of the inserts and between them, apart from short turned grooves in the axial direction which may be present, so that they can be machined from just one side of the valve housing, i.e. without changing the position of the valve housing or of the tool. A spacer bushing is arranged axially between two inserts, said bushing ensuring a fixed distance between two inserts on different sides of the piston, even when the diameter of the receiving bore remains constant. The insert which is close to the piston collar on each side of the piston collar is manufactured from a metallic material having good sliding properties, for example from a copper beryllium alloy, and has, at its inside diameter, a quite narrow clearance over its entire axial extent from the corresponding end section of the poppet piston, i.e. guides the corresponding end section tightly over its entire axial length. In spite of an obtained improvement over the non-return valve disclosed in DE 197 14 505 A1, even in the non-return valve according to DE 198 56 018 A1, jamming of the poppet piston has still been established at very high pressures.

The invention is therefore based on the object of developing an unlockable non-return valve having the features from the preamble of claim 1 in such a manner that the tendency of the poppet piston to jam is reduced.

According to the invention, this object is achieved in an unlockable non-return valve according to the preamble of claim 1 by the fact that this valve is additionally provided with the features from the characterizing part of claim 1. The invention is first of all based on the finding that the stiffness or even the jamming of the poppet piston in the known valves is also caused by deformation of the first inserts close to the piston collar. The deformation is caused by the high-pressure seal which is held in the turnout of the second insert and is supported axially on the first insert close to its inside diameter. At very high pressures, the force exerted on the first insert by the high-pressure seal is so large that the insert becomes deformed, its inside diameter, and the poppet piston becomes jammed.

According to the invention, first of all the first insert has a guide diameter for the end section of the poppet piston over just a short section of its end side facing the piston collar. Within the section described, the inside diameter of the insert is not reduced if the insert becomes deformed. Outside the section described, the inside diameter of the first insert is selected to be such a size that, in spite of a reduction in the inside diameter caused by the deformation, jamming of the poppet piston is still not caused. The supporting ring, which is situated axially between the high-pressure seal and the first insert in a receiving element which is formed between the two inserts and is open radially toward the end section of the poppet piston, has, at its outside diameter, a larger clearance in the receiving element, so that changes, which are caused by deformation, in the diameter of the receiving element do not have an effect on the supporting ring. The latter also has a substantially smaller outside diameter than the inserts, so that the engagement point of the force exerted by the high-pressure seal and the bearing point of the supporting ring against the first insert are situated axially at least approximately one above the other and the supporting ring is also hardly deformed directly. In spite of the narrow clearance between the supporting ring and end section of the poppet piston, the clearance preventing the high-pressure seal from migrating into the gap between the supporting ring and the end section of the poppet piston, in an unlockable non-return valve according to the invention, the force exerted by the high-pressure seal in the axial direction on the supporting ring and the first insert no longer causes the poppet piston to jam.

Advantageous refinements of an unlockable non-return valve according to the invention can be gathered from the subclaims.

As described in claim 2, the first insert preferably has, in front of its section with the guide diameter, a clearance of at 1/10 mm, preferably of 2/10 mm, radially with respect to the end section of the poppet piston. As a result, the distance from the poppet piston is sufficiently large in order, despite deformation, to avoid jamming. On the other hand, a radial seal between the insert and end section is still supported axially to such an extent that it does not migrate [lacuna] the gap which is present.

According to patent claim 3, the outside diameter of the supporting ring is approximately 1.1 times as large as the diameter of the turn-out for the high-pressure seal, i.e. extends radially only a relatively small distance beyond the high-pressure seal, so that a not all too large offset between the point at which the force is introduced by the high-pressure seal and the point at which the supporting ring bears against the first insert can occur.

According to patent claim 4, the radial clearance between the supporting ring and the end section of the poppet piston is very small, so that migration of a part of the high-pressure seal into the radial gap between the supporting ring and end section of the poppet piston is very reliably avoided.

Other advantageous developments of an unlockable non-return valve according to the invention are the subject matter of further subclaims.

An exemplary embodiment of an unlockable non-return valve according to the invention and the principle of a hydraulic circuit for the internal high-pressure forming, within which circuit a non-return valve according to the invention can be used, are illustrated in the drawings. The invention will now be explained in greater detail with reference to these-drawings, in which FIG. 1 shows the hydraulic circuit diagram, and FIG. 2 shows a longitudinal section through the exemplary embodiment of a non-return valve according to the invention.

Figure 2:
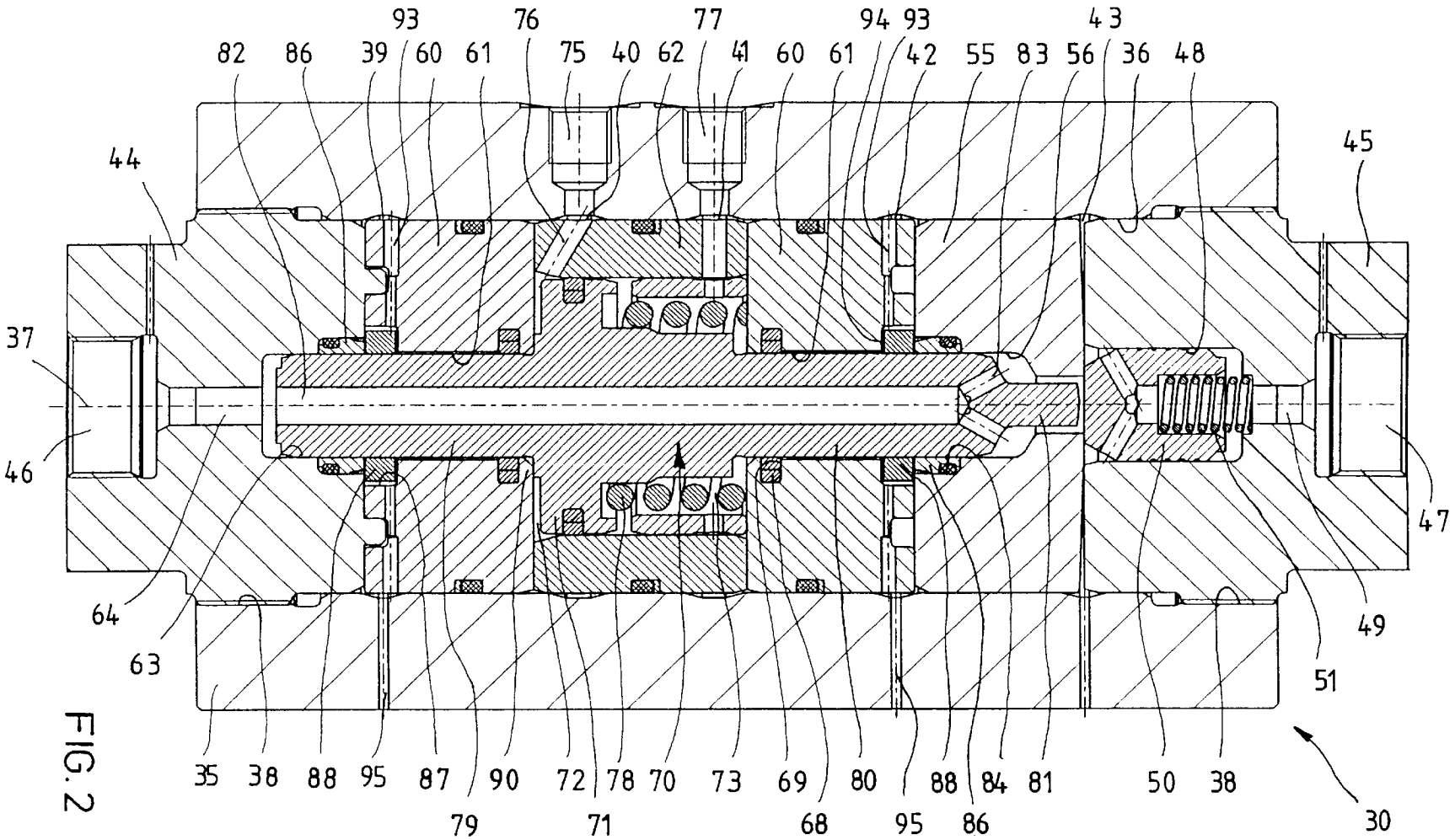

The circuit diagram of FIG. 1 only shows an excerpt from the hydraulic part of an internal high-pressure forming system. The most important part of the hydraulics of a system of this type is a pressure intensifier 10 which contains, in a multi-part housing 11, a differential piston 12 whose surface ratio determines the ratio of pressure intensification. The diameter of the differential piston 12 is substantially smaller at a secondary piston section 13 than at a primary piston section 14. The latter divides an interior space of the housing 11 into an annular space 15 and a cylindrical space 16. The two spaces are connected via working lines 17 and 18 to a proportionally adjustable directional control valve 19 which, in its central rest position, connect the two working lines, and therefore the annular space 15 and the cylindrical space 16, to a tank via a tank connection T. In a first working position of the directional control valve 19, the annular space 15 is connected to a hydraulic pump 20 via a pump connection P, while the cylindrical space 16 remains connected to the tank. In the other working position of the directional control valve 19, the cylindrical space 16 is connected to the hydraulic pump and the annular space 15 is connected to the tank.

A displacement sensor 23 senses the position of the differential piston 12 with respect to the housing 11.

The space 24 upstream of the end side of the secondary piston section 13 is connected, on the one hand, via a simple non-return valve 25, which opens toward it, to a storage container 26 which contains a hydraulic fluid based on water. On the other hand, an unlockable non-return valve 30 according to the invention is connected to the pressure space 24 and pressure medium can readily flow out of the pressure space 24 through said non-return valve 30 to a line 31 which can be connected to the semi-finished product to be formed. The line 31 is also connected to the storage container 26 via a non-return valve 32 which opens toward it. During operation, the semi-finished product is filled with hydraulic fluid from the storage container 26 via the line 31 and the non-return valve 32, it also being possible to arrange a pump between the storage container 26 and the non-return valve 32, which pump brings about filling up to a certain pressure. The directional control valve 19 is then brought into its second working position, in which hydraulic oil is supplied by the pump 20 to the cylindrical space 16 of the pressure intensifier 10. The differential piston 12 moves upward, as viewed in FIG. 1, and displaces hydraulic fluid from the pressure space 24 via the unlockable non-return valve 30 into the line 31, so that the pressure in the semi-finished product to be deformed increases. Depending in each case on how large the volume of the semi-finished product, the increase in the volume due to the deformation and the level of the final pressure are, one or more strokes of the differential piston 12 are necessary. For a second stroke, the directional control valve 19 is brought into its first working position, so that the differential piston 12 travels downward and hydraulic fluid is sucked into the pressure space 24 from the storage container 26 via the non-return valve 25. After the directional control valve 19 is switched over again, hydraulic fluid is pressed in turn out of the pressure space 24 into the line 31 via the non-return valve 30.

After deformation and calibration of the workpiece are finished, the non-return valve 30 is unlocked, by applying a control pressure to a control channel 33, so that the space within the workpiece and the line 31 can be decompressed by the differential piston 12 moving back.

The construction and the manner of operation of the non-return valve 30 emerge in greater detail from FIG. 2. The exemplary embodiment shown there of a non-return valve according to the invention has a valve housing 35 through which a receiving bore 36, whose axis may be referred to as the valve axis 37, passes. The receiving bore 36 has the same diameter throughout, apart from two sections 38 at its two ends, which sections are provided with an internal thread, and apart from flat turned grooves 39, 40, 41, 42 and 43 further to the inside, and, in the region of this constant diameter, may be machined from only one side of the valve housing 35. A total of six parts are inserted clamped axially against one another into the receiving bore 36. First of all, high-strength inserts 44 and 45 are screwed into the sections 38 of the receiving bore 36, and each of said inserts has, on the valve axis 37, a respective threaded bore 46 and 47 serving as the first and second orifices of the valve and to which a respective pressure line can be connected. The inserts 44 and 45 dip via the sections 38 into the region of constant diameter of the receiving bore 36 and are centered therein. The insert 45 has an inwardly open blind bore 48 which is connected via a relatively narrow channel 49 to the threaded bore 47 and which receives and guides a closing element 50, which is loaded in the direction out of the blind bore 48 by a weak closing spring 51.

The insert 45 is followed axially by a likewise high-strength insert 55 which is in the form of a washer and has a central passage 56 with two steps. Around the narrowest section of the central passage, the insert 55 serves as a seat for the closing element 51. The insert 55 is followed by a washer 60 having a central passage 61, then by a spacer bushing 62 whose inside diameter is substantially larger than the diameter of the central passage 61 in the washer 60, then by a further washer 60 having a central passage 61, which washer is identical to the former washer 60 but is fitted in the opposite direction thereto, and then by the insert 44. Like the insert 45, said insert 44 has an inwardly open blind bore 63 which, however, is less deep than the blind bore 48 and also has a smaller diameter. This diameter corresponds, except for slight differences, with the diameter of the central passages 61 in the washers 60 and with the diameter of the central section of the central passage in the insert 55. The blind bore 63 is also connected to the threaded bore 46 via a channel 64 which is narrower in diameter.

A poppet piston 70 is accommodated in the interior of the inserts 55, 60 and 44 and in the interior of the spacer bushing 62 and, with the aid of the poppet piston, the closing element 50 can be raised from its seat counter to the force of the closing spring 51 and counter to a force produced by the pressure in the second orifice 47 of the valve.

The poppet piston has a piston collar 71 which is situated within the spacer bushing 62 and divides the space surrounded by the washers 60 and the spacer bushing 62 into two annular spaces 72 and 73. The annular space 72 can be acted upon by a control pressure or can be relieved from pressure via an external connection 75 and with the aid of a pilot valve (not illustrated in greater detail). The turn-out 40 of the valve housing 35 and an oblique bore 76 in the spacer bushing 62 lie in the flow path between the external connection 75 and the annular space 72. The other annular space 73 is connected via a second external connection 77 to an oil container, for the purpose of equalizing the volume and for conducting away leaked fluid, and also accommodates a restoring spring 78 for the poppet piston 70. In addition, a bushing 74, by means of which the stroke of the poppet piston 70 is limited, is situated in the annular space 73 radially between the restoring spring and the spacer bushing 62. Said poppet piston thus strikes against the washer 60 but not in the vicinity of its inside diameter where there would also be the risk of a deformation of material due to an annular groove 69 of the washer 60, which groove is situated at a short distance from the end side facing the annular space 73, and which accommodates a seal 68.

On both sides of the piston collar 71, the poppet piston has shaft-journal-like end sections 79 and 80 with which it dips through the central passages 61 of the washers 60 and into the blind bore 63 of the insert 44 and into the central passage 56 of the insert 55. Toward the closing element 50, the one end section 80 is extended by a finger 81 which can act upon the closing element 50 through the narrowest section of the central passage 56 of the insert 55. In the rest position shown of the poppet piston 70, there is a small distance between the finger 81 and the closing element 50. The flow path between the orifices 46 and 47 of the valve leads axially through the poppet piston 70 which, for this purpose, has a long axial bore 82, which opens into the blind bore 63 of the insert 44, and a plurality of small oblique bores 83 at the base of the finger 81.

A high-pressure seal 86 is accommodated in a turn-out 84, which forms that section of the central passage 56 of the insert 55 which is the widest and open axially toward the one washer 60, said seal being acted upon axially in the direction of the washer 60 by the high pressure prevailing in the passage 56, but, of course, also acting radially toward the poppet piston 70. In the present case, the high-pressure seal comprises a guide ring bearing against the poppet piston, a rubber-elastic O-ring lying in a groove of the guide ring, which groove is open radially outward, and a metallic, wedge-shaped ring bearing on the outside against a conically tapering surface on the guide ring. The seal 68 also acts radially in the annular groove 69 of the washer 60. Identical seals 68 and 86 are located in a turn-out 84 of the insert 44 and in an annular groove 69 of the other washer 60.

The high-pressure seals 86 are not pressed directly against the washers 60 by the high pressure. Rather, each washer 60 has a receiving element 87 which is open axially toward the insert 44 or 55 and radially toward the end section 79 or 80 of the poppet piston 70 and accommodates a supporting ring 88 which is made of the same material, which has good sliding properties, as the washers 60, for example a copper beryllium alloy, and which is guided on the end section 79 or 80 with the narrow clearance of approximately 2/100 mm. The high-pressure seal 86 bears against this supporting ring 88. The outside diameter of the supporting ring 88 is only approximately 1.1 times as large as the outside diameter of the high-pressure seal 86 and the turnout 84 accommodating the latter, while the outside diameter of the washers 60 is more than 2.5 times as large. The diameter of the receiving element 87 is at least larger than the outside diameter of the supporting ring 88 by such an amount that said outside diameter is not loaded even when the diameter of the receiving element is reduced due to forces radially from the outside which act on the washer 60. When a force is introduced by the high-pressure seal 86 onto the supporting ring 88, this force in every case is passed to the washer 60 radially not further to the outside than at the outside diameter of the supporting ring, therefore virtually precisely opposite it. In the axial direction, the receiving element 87 and the supporting ring 88 are dimensioned in such a manner that the supporting ring has sufficiently great dimensional stability even at the maximum possible radial offset of the force transmission point between it, the high-pressure seal and the washer 60. In the present case, the supporting ring extends for this purpose axially approximately over 1/5 of the axial length of the washers 60. It could also be longer, but then more chip-forming machining of the washers 60 would be necessary.

The inside diameter of the washers 60 is, in the section 90 between their end side facing the annular space 72 or 73 and the annular groove 69, i.e. just over a short section from the end side, is only slightly larger than the diameter of an end section 79, 80 of the poppet piston. In the section 90 of a washer 60, an end section 79, 80 of the poppet piston 70 is guided with a radial clearance of 1/100 mm to 2/100 mm. Between the annular groove 69 and the receiving element 87 there is, between a washer 60 and an end section 79, 80, a larger radial gap with a width in the region of 2/10 mm. This gap, which is shown greatly enlarged in FIG. 2 for the sake of clarity, is of a sufficient size so as to avoid, when a washer 60 is deformed during the operation by the force exerted on it by a high-pressure seal 86 via a supporting ring 88, a fixed positioning of the washer on an end section 79, 80 of the poppet piston 70 and therefore jamming of the latter.

In the valve which is shown, the separating gaps between the one washer 60 and the insert 44, between the other washer 60 and the insert 55 and between the insert 55 and the insert 45, and the radial gap, located axially between the seal 69 and a supporting ring 88, between a washer 60 and an end section 79, 80 of the poppet piston 70 are relieved from pressure. For the pressure relief between the two inserts 55 and 45, that end side of the insert 55 which faces the insert 45 is formed such that it is slightly conically toward the outside at a distance from the valve axis 37, with the result that, on the one hand, for radial sealing, the inserts 45 and 55 can bear tightly against each other a good distance inward, and, on the other hand, an annular space is provided which increases in its axial extent radially toward the outside and from which leaked fluid is conducted away via a housing bore.

For pressure relief between the washers 60 and the inserts 44 and 45, a plurality of radial bores 93 pass through each washer 60, said radial bores opening on the inside into a receiving element 87 and being open on the outside toward a turned groove 39 or 42. In that end side of a supporting ring 88 which faces a washer 60 are situated two or more tracks 94 which run from the inside to the outside and via which the radial gap between a washer 60 and the end section 79, 80 of the poppet piston 70 is connected to the radial gap between a supporting ring 88 and a washer 60. The pressure medium passing, owing to leakage, into the turned grooves 39 and 42 is conducted away through housing bores 95. The washers 60 are therefore never exposed to the maximum pressure which is possible in the orifices 46 and 47 of the valve and, as regards the selection of material, can be matched entirely to their function as guides for the poppet piston 70. They are primarily produced from a copper beryllium alloy. In contrast, the inserts 44, 45 and 55 are loaded during operation by the maximum pressure and are therefore produced from a high-strength material. The fit between the end sections 79 and 80 of the poppet piston and the inserts 44 and 55 is selected in such a manner that the guiding of the poppet piston 70 takes place in the washers 60.

The seals in the washer 60 between the spacer bushing 62 and the insert 55 seal off spaces from one another in which essentially the same pressure prevails. Their function essentially involves separating different hydraulic fluids from one another. This is because the annular space 73 is conventionally filled with oil while the pressure medium used for the high-pressure forming is water.

When the unlockable non-return valve, which is shown in FIG. 2, is used in the hydraulic circuit according to FIG. 1, the first orifice 46 is connected to the pressure space 24 of the pressure intensifier 10 and the second orifice 47 is connected to the line 31. If the pressure intensifier displaces water out of the pressure space 24, said water flows to the second orifice 47 via the channels 64, 82, 83, 56, via the closing element 50 which is raised from its seat, and via the channel 49 in the insert 45. For the already mentioned decompression of the liquid forming means, the annular space 72 is acted upon via the external connection 75 with control pressure, so that the poppet piston 70 moves toward the closing element 50 and raises the latter from its seat. The raising takes place counter to the force of the restoring spring 78 and counter to a compressive force which is caused by a possible pressure difference between the orifices 45 and 46 and by different engagement surfaces on the closing element 50 for the pressures in the orifices 45 and 46, and counter to the negligibly small force of the closing spring 51. The compressive force can indeed be brought virtually to zero at the beginning by a pressure-controlled movement of the differential piston 12. However, during the decompression which then follows, a quantity of hydraulic fluid, the amount of which depends on the desired speed at which said decompression takes place, has to flow out of the line 31 via the valve 30 into the pressure space 24, as a result of which a pressure difference occurs via the closing element 50. The closing element has to be held open by the poppet piston 70 counter to this pressure difference. Owing to the large diameter of the piston collar 71, this is achieved by control pressures which can conventionally be built up nowadays by hydraulic pumps.

We claim:

1. An unlockable non-return valve for very high system pressures having a valve housing (35) with a continuous receiving bore (36) located on a valve axis (37), having a closing element (50) which is prestressed in closing direction by a closing spring (51) and moveable in direction of the valve axis (37), having a poppet piston (70) which is actable upon at a piston collar (71) by a control pressure in order to unlock the closing element (50) and, on both sides of the piston collar (71), is guided on end sections (79, 80) of at least approximately identical diameters in the direction of the valve axis (37), and having two inserts (44, 60, 55, 60), which are placed into the receiving bore (36), on each side of the piston collar (71), into which the poppet piston (70) dips with an end section (79, 80), the end section (79, 80) being guided in an insert (60) which is close to the piston collar (71) and is made from a metallic material having good sliding properties, and a second insert (44, 55) following the first insert (60) has, in a turn-out (84) which is open radially toward the end section (79, 80) and axially toward the first insert (60), a high-pressure seal (86) which bears radially against the end section (79, 80) of the poppet piston (70) and is supported axially by the first inset (60), wherein the first insert (60) has a guide diameter for the end section (79, 80) of the poppet piston (70) over just a short section of its end side facing the piston collar (71), and by the fact that a supporting ring (88) is arranged axially between the high-pressure seal (86) and the first insert (60) in a receiving element (87) which is formed between the two inserts (44, 60, 55, 60) and is open radially toward the end section (79, 80) of the poppet piston (70) and diameter of which is substantially smaller than the outside diameter of the inserts (44, 60, 55, 60), said supporting ring (88) likewise being made of a metallic material having good sliding properties and being produced with a narrow clearance from the end section (79, 80) of the poppet piston (70) and with a large radial clearance from the receiving element (87).

2. The unlockable non-return valve as claimed in claim 1, wherein the first insert (60) has, in front of its section (72) with the guide diameter, a clearance of at least 1/10 mm, radially with respect to the end section (79, 80) of the poppet piston (70).

3. The unlockable non-return valve as claimed in claim 1, wherein the first insert (60) has, in front of its section (72) with a guide diameter, a clearance of at least 2/10 mm, radially with respect to the end section (79, 80) of the poppet piston (70).

4. The unlockable non-return valve as claimed in claim 1, wherein the outside diameter of the supporting ring (88) is approximately 1.1 times as large as the diameter of a turn-out for the high-pressure seal (86).

5. The unlockable non-return valve as claimed in claim 1, wherein the radial clearance between the supporting ring (88) and the end section (79, 80) of the poppet piston (70) lies in a range of 1/100 mm to 2/100 mm.

6. The unlockable non-return valve as claimed in claim 1, wherein the receiving element (87) for the supporting ring (88) is situated entirely in the first insert (60).

7. The unlockable non-return valve as claimed in claim 1, wherein axial extent of the supporting ring (88) is approximately 1/5 of axial extent of the first insert (60).

8. The unlockable non-return valve as claimed in claim 1, wherein in at least one of axial surfaces, which bear against each other, of the first insert (60) and supporting ring (88) is situated at least one track (94) extending from inside diameter of the surface as far as outside diameter of the supporting ring (88), and wherein a leakage duct (93, 39, 42, 95) leads to outside from a gap on the outside diameter of the supporting ring (88).

* * * * *